United States Patent [19]

McCreary, Jr.

[11] Patent Number: 5,063,694

[45] Date of Patent: Nov. 12, 1991

[54] LIGHTWEIGHT EXCAVATOR DIPPER WITH REPLACEABLE TOP AND BOTTOM SECTIONS

[75] Inventor: Robert A. McCreary, Jr., Gillette, Wyo.

[73] Assignee: Atlantic Richfield Company, Los Angeles, Calif.

[21] Appl. No.: 651,163

[22] Filed: Feb. 6, 1991

[51] Int. Cl.[5] ..... E02F 5/02

[52] U.S. Cl. ..... 37/103; 37/118 A; 37/DIG. 12; 414/726

[58] Field of Search ..... 37/103, 118 A, 141 R, 37/DIG. 12, 117.5, 118 R; 414/722, 725, 726

[56] References Cited

U.S. PATENT DOCUMENTS

| | | | |
|---|---|---|---|
| 1,813,110 | 7/1931 | Bauer | 37/118 R |
| 3,070,246 | 12/1962 | Johnson et al. | 37/117.5 X |
| 3,307,277 | 3/1967 | Kondracki | 37/141 R |
| 3,341,041 | 9/1967 | Salna | 37/DIG. 2 X |
| 3,767,070 | 10/1973 | Arnold | 414/726 X |
| 3,773,196 | 11/1973 | Shepherd | 414/726 X |
| 3,854,608 | 12/1974 | Arnold | 37/117.5 X |
| 3,921,316 | 11/1975 | Moreau | 37/118 A |
| 4,081,919 | 4/1978 | Teach | 37/103 |
| 4,457,085 | 7/1984 | Arnold | 37/103 |
| 4,550,512 | 11/1985 | Felstet | 37/117.5 |
| 4,691,455 | 9/1987 | Newman | 37/103 |
| 4,939,855 | 7/1990 | McCreary, Jr. | 37/103 |

*Primary Examiner*—Dennis L. Taylor
*Assistant Examiner*—J. Russell McBee
*Attorney, Agent, or Firm*—Michael E. Martin

[57] ABSTRACT

An excavating dipper for use with power shovels, draglines and the like is fabricated from steel plate and is formed to have a separable bottom body member, which may be replaced when worn. The dipper is of lightweight steel plate construction fabricated into substantially all welded top and bottom body members. The plate members forming the side and bottom walls of the bottom body member are reinforced by longitudinal and transverse girth ribs.

24 Claims, 3 Drawing Sheets

LIGHTWEIGHT EXCAVATOR DIPPER WITH REPLACEABLE TOP AND BOTTOM SECTIONS

BACKGROUND OF THE INVENTION

1. Field of the Invention

The present invention pertains to an excavating bucket or dipper having lightweight fabricated top and bottom sections which are separable for replacement when damaged or worn out.

2. Background

Excavating shovel dippers or buckets must have adequate strength to withstand the high forces exerted thereon during excavation operations and be able to resist abrasive wear by the material being excavated. At the same time, it is important to minimize the mass of the dipper structure so that the payload capacity of the operating machine is not compromised or reduced by the weight of the dipper itself.

My U.S. Pat. No. 4,939,855, assigned to Atlantic Richfield Company, describes one method and arrangement of an excavating bucket or dipper wherein the heavy cast or fabricated structures of the prior art are modified to include a lightweight replaceable lower or bottom section. However, there has been a need to develop a lighter weight dipper structure which also includes replaceable upper and lower sections so that the lower section of the dipper, in particular, which is subject to high wear rates, may be replaced without requiring replacement of the upper or top section. Alternatively, of course, it may be desirable to replace the upper or top section before replacement of the bottom section. The reduction in dipper weight without sacrificing strength and durability has presented certain problems in dipper design which are solved by the unique, lightweight dipper according to the present invention.

SUMMARY OF THE INVENTION

The present invention provides a unique, lightweight excavator dipper or bucket having replaceable top and bottom sections.

In accordance with one aspect of the present invention, a lightweight excavating dipper is provided which is formed substantially entirely of fabricated metal plate in top and bottom sections of the dipper which are secured together along mating flange portions whereby the bottom section may be separated from the top section and replaced when worn or damaged from use.

The present invention still further provides an excavating dipper which is made up of a plurality of fabricated metal plates which are suitably welded together and form a lightweight, yet durable, structure which increases the payload capacity of the dipper without materially reducing the dipper's useful life.

In accordance with another important aspect of the present invention, an excavating dipper is provided which includes a combination of longitudinal stiffening ribs and transverse stiffening ribs for reinforcing the dipper sections, in particular, the bottom section.

The present invention yet further provides a unique excavating dipper having internal brace or divider members provided which strengthen and add rigidity to the dipper during use.

The above-mentioned features and superior aspects of the present invention, together with other advantages, will be further appreciated by those skilled in the art upon reading the detailed description which follows in conjunction with the drawing.

DESCRIPTION OF A PREFERRED EMBODIMENT

Figure 1:
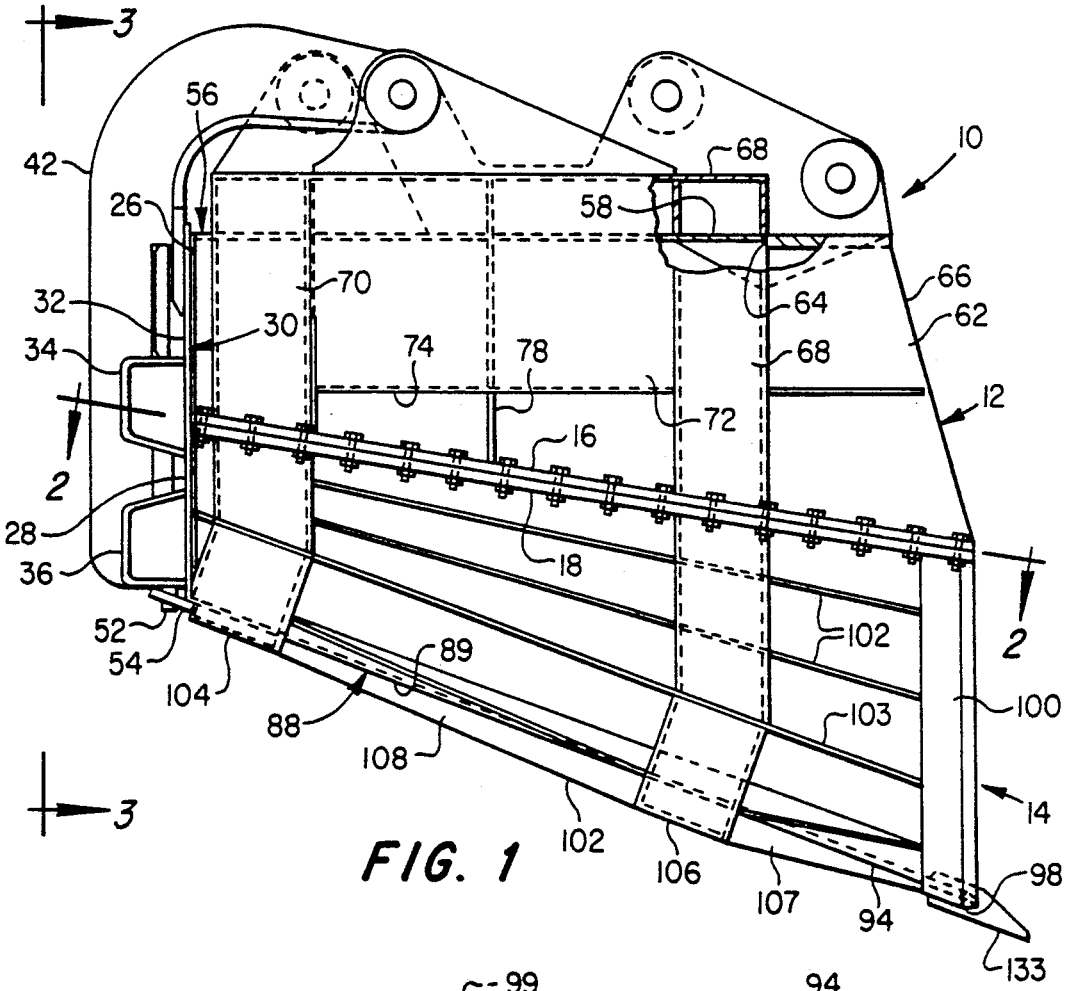
FIG. 1 is a side elevation of the excavator dipper in accordance with the present invention.

In the description which follows, like parts are marked throughout the specification and drawing with the same reference numerals, respectively. The drawing figures are not necessarily to scale, and certain elements may be shown exaggerated in scale in the interest of clarity.

Referring to FIG. 1, there is illustrated an approved excavating dipper, generally designated by the numeral 10. The dipper 10 includes separable top and bottom body portions 12 and 14, which are secured together along cooperating flanges disposed along each side of the body portions 12 and 14 and designated by the numerals 16, 18, 20 and 22, see FIG. 5 also. The flanges 16 and 18 are secured together with a plurality of bolt assemblies 24, and the flanges 20 and 22 are similarly secured together by bolt assemblies 24. The top and bottom body portions 12 and 14 are basically somewhat U-shaped members which are open at opposite ends. The material dump end of the body portion 12 is delimited by an end face 26 which is coplanar with an end face 28 of the body portion 14 to form a dump opening for the dipper 10.

The opening defined by the end faces 26 and 28 may be closed by a dump door, generally designated by the numeral 30. The door 30 includes a generally planar plate-type closure member 32, see FIG. 3 also, which is reinforced by transversely extending ribs 34 and 36 which are formed as hollow members having a generally trapezoidal cross-section, see FIG. 1. The door 30 is supported on the top body 12 by spaced-apart pivot arms 40 and 42, which are suitably pivotally connected to spaced-apart hinge plates or bosses 44 and 46, see FIG. 3 also. The bosses 44 and 46 are generally planar members which are preferably welded to, and form part of, the top body member 12. A conventional dump door release mechanism comprising a lever arm 48 and a latch member 50 are also supported on the door 30. The latch member 50 includes a tang 52, which is operable to project into a slot formed in a latch plate 54, see FIG. 1, to hold the door 30 in the closed position shown in FIGS. 1 and 3. The latch plate 54 is secured to the bottom side of the lower body member 14, as will be described in further detail hereinbelow.

Figure 2:
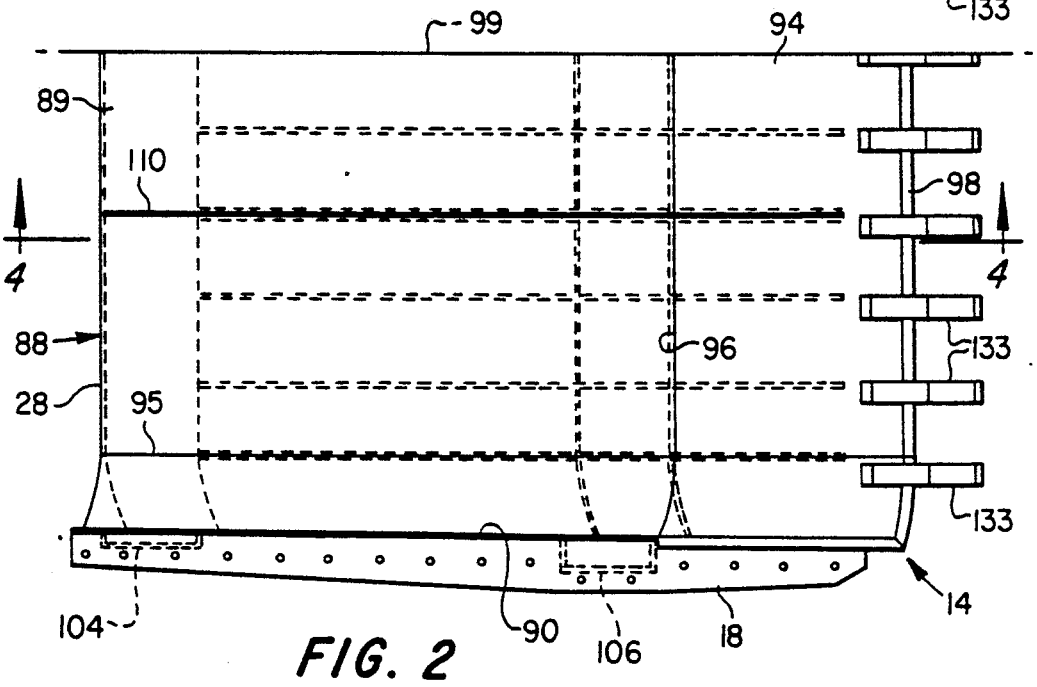
FIG. 2 is a partial plan view of the bottom dipper section, taken generally from the line 2—2 of FIG. 1.
Figure 3:
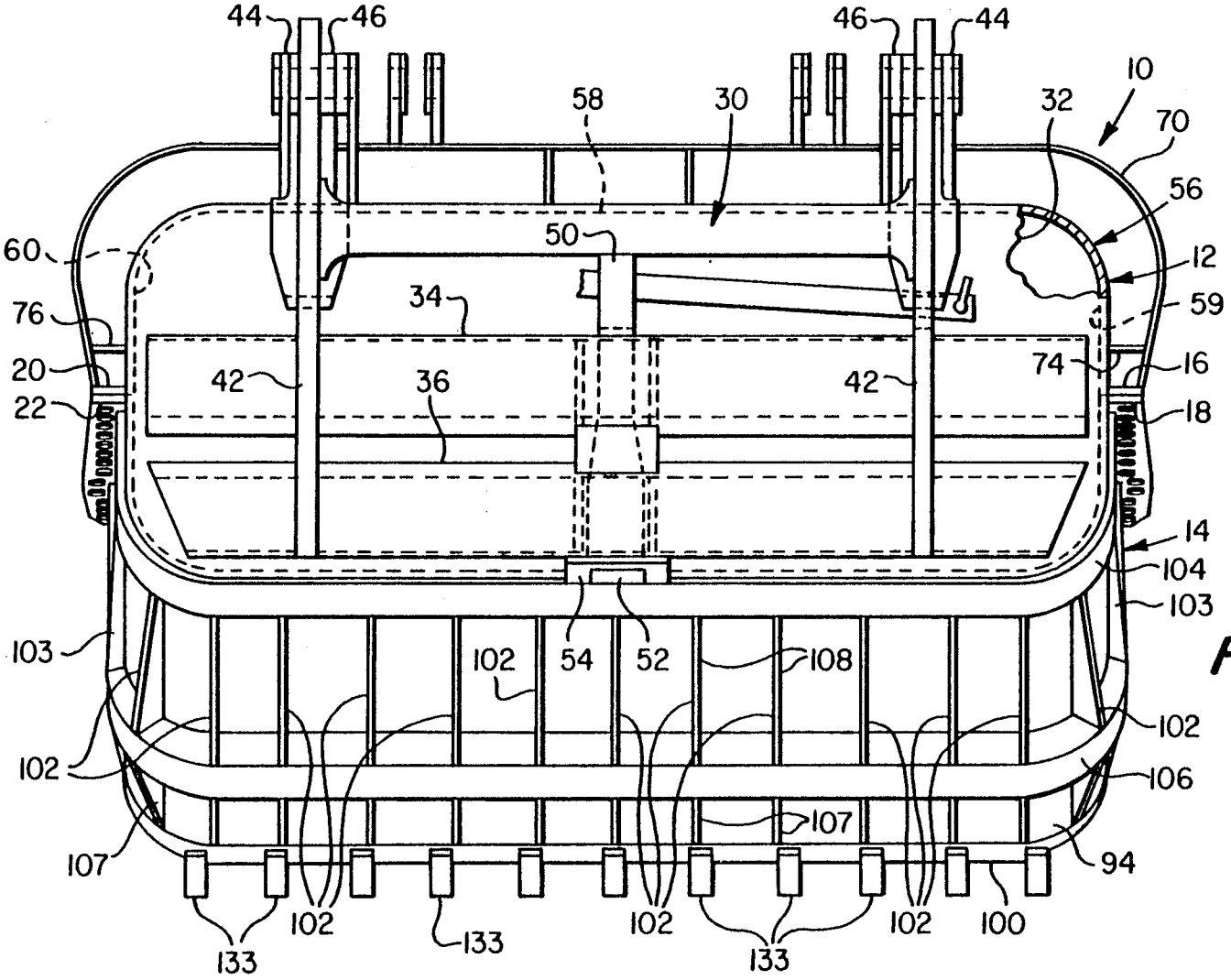
FIG. 3 is a rear elevation, taken generally along the line 3—3 of FIG. 1.

The top body member 12 is primarily made up of a main body plate 56, see FIGS. 1, 2 and 3, having a top wall portion 58 and opposed depending side wall portions 59 and 60, FIG. 3. The plate 56 is welded to a front lip plate 62, which is also bent to conform generally to the shape of the plate 56, and is welded thereto along a joint 64, FIG. 1. The plate 56 and the lip plate 62 are proportioned such that the front edge 66 of the lip plate is slightly flared outwardly with respect to the rear edge 26 to provide draft in the interior space delimited by the top and bottom body members.

The top body member 12 is further characterized by spaced-apart, transversely extending girth ribs 68 and 70. The rib 68 is preferably disposed adjacent the joint 64, and the rib 70 is disposed near the rearward edge 26 of the upper body member. The ribs 68 and 70 are preferably configured somewhat as hollow beams having a rectangular cross-section formed by top and side walls, respectively. The ribs 68 and 70 extend from the flange 16 to the flange 20 and are reinforced by a web plate 72 extending between the ribs and over the top of the top body member and down both sides to a point delimited by longitudinal stiffening members 74 and 76, see FIG. 3. A generally transverse stiffening member 78 extends between the flanges 16 and 20 and is coextensive with the plate 72, as shown partially in FIG. 1 and FIG. 5. The top body member 12 also includes a plurality of spaced-apart connector support plates 80, 82, 84 and 86, see FIGS. 1 and 3, which provide for connecting the dipper 10 to a conventional dipper stick, not shown.

Figure 4:
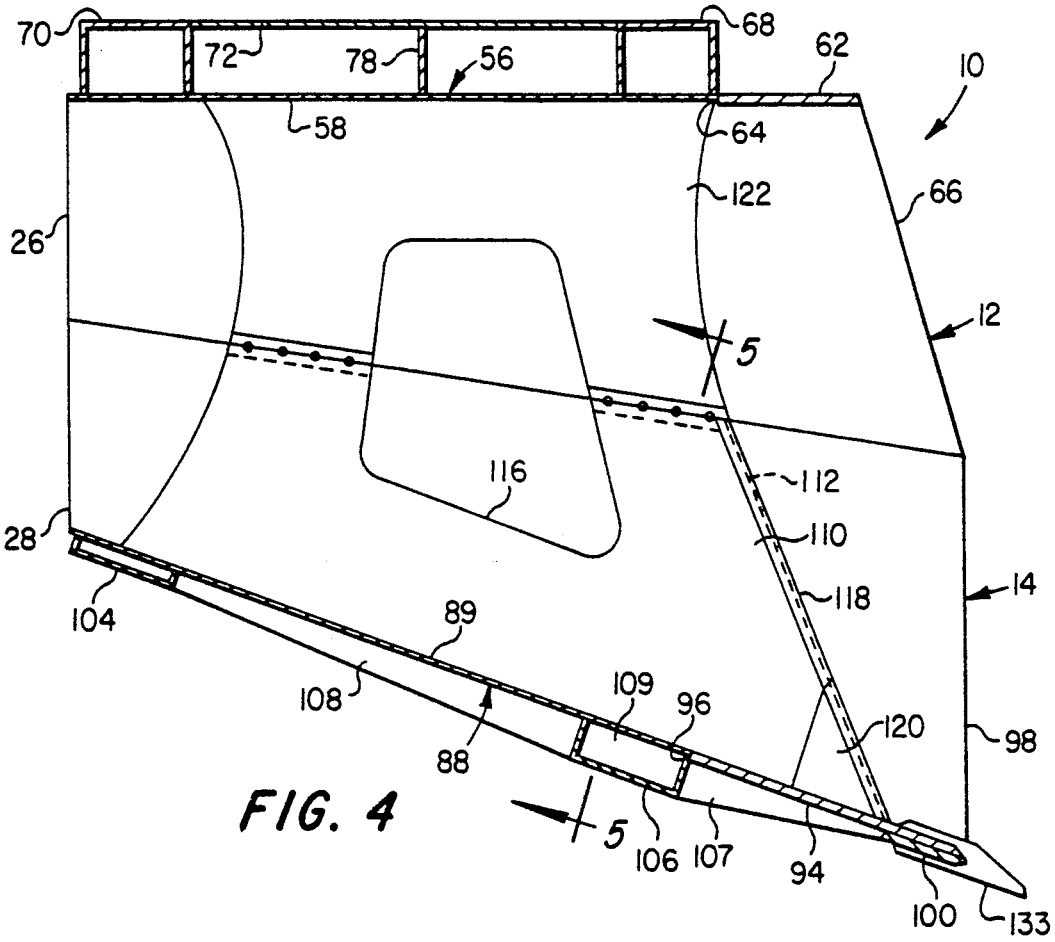
FIG. 4 is a section view, taken generally along the line 4—4 of FIG. 2.
Figure 5:
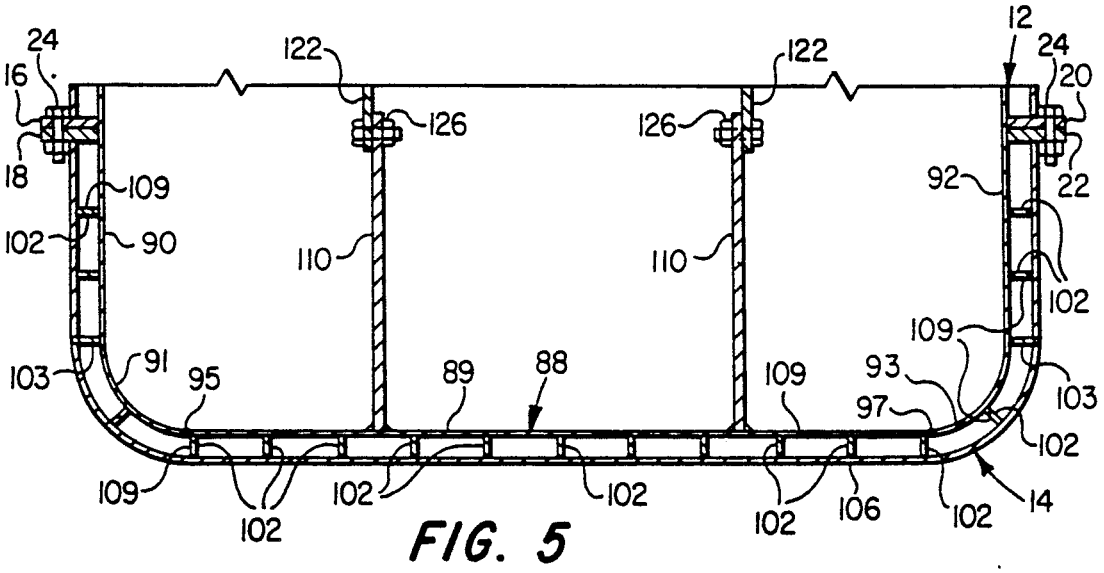
FIG. 5 is a section view, taken along the line 5—5 of FIG. 4.

Referring now to FIGS. 1, 2 and 4, the bottom body member 14 is characterized by a main body plate 88 which extends from the flange 18 to the flange 22, see FIG. 5 also, and includes a bottom wall portion 89 and opposed generally vertical side wall portions 90 and 92. A forward lip plate 94, of greater thickness than the plate 88, is welded to the plate 88 along a joint 96, FIG. 2. The plates 88 and 94 may also be formed in opposed half sections which are joined along a centerline 95, FIG. 2. Alternatively, as shown, the plate 88 may be made up of three separate plates comprising the bottom wall 89 and the opposed side walls 90 and 92, which are joined along seams which run normal to the plane of the paper in FIG. 5 and are designated by the numerals 95 and 97. The side wall portions 90 and 92 thus require bending to form curved portions 91 and 93, FIG. 5. The bottom plate 88 and the lip 94 are proportioned such that a front edge 98 defines a larger opening than that formed by the rear edge 28. The lip plate 94 is also reinforced along the edge 98 by a wearband 100, FIGS. 1 and 4, suitably welded to the forward portion of the lip plate 94, as illustrated.

As illustrated in FIGS. 2 and 5, the flanges 18 and 22 are suitably welded to the upper longitudinal edges of the side wall portions 90 and 92 and the lip plate 94. The body member 14 is reinforced by plural longitudinally extending ribs or stiffening members 102, which are preferably substantially equally spaced apart along the side wall portions 90 and 92, the intermediate curved wall portions 91 and 93 and the bottom wall portion 89, as illustrated in FIGS. 1, 2 and 5.

In the exemplary dipper 10, there are two longitudinally extending ribs 102 along each vertical side wall portions 90 and 92, one rib 102 extending along the curved side all portions 91 and 93, respectively, and eleven longitudinally extending ribs 102 along the bottom wall 89. The ribs 102 extend forwardly toward the edge 98 from a hollow-box-type transverse girth rib 104 adjacent the rear edge 28, are intersected by a second transverse girth rib 106 and are tapered to termination at the wear plate 100. As shown in FIG. 5, the girth ribs 104 and 106 are of a generally hollow box-like configuration formed of suitable side and bottom plate members welded together to form a box beam-type member utilizing the bottom plate 89 and the side wall portions 90 and 92 as part of the so-called box beam. As shown in FIGS. 1 and 5, longitudinal ribs 103 extend from the rear edge 28 to the wear band 100 along the juncture of the vertical side wall portions 90 and 92 with the respective curved portions 91 and 93. It should be noted that each of the ribs 103 is a continuous piece extending from the wear plate 100 to at least the rear edge of the box beam rib 104. On the other hand, each of the ribs 102 may be made up of separate parts 107, 108 and a part 109 interior of the box beam rib 106, as illustrated in FIG. 4 and FIG. 5.

Turning now to FIGS. 4 and 5, in particular, the body 14 is also provided with longitudinal, upstanding stiffening plates 110, which are spaced apart approximately one-third of the lateral span of the dipper 10, respectively. The stiffening plates 110 are suitably welded to the bottom plate 89 and have tapered forward and rear edges 112 and 114, respectively, to form a generally trapezoidal shape in plan view. A recess 116 is formed in the stiffening plate 110 to reduce weight and friction. The forward edge 112 of each plate 110 is preferably formed to have a hard metal cap 118 suitably welded thereon to reduce the wear rate of the edge. Triangular gussets 120 are suitably welded to the lip 94 and the lower front edge 112 on either side of the plates 110, as illustrated by way of example in FIG. 4. As also shown in FIGS. 4 and 5, the body 12 also has longitudinal depending stiffening plates 122 which depend from the top wall 58. As shown in FIG. 5, each of the plates 122 is spaced to lie directly adjacent the respective stiffening plates 110, and the plates 110 and 122 are bolted together along a linear bolt pattern by suitable threaded bolt assemblies 126. Alternatively, the assembled plates 110 and 122 may be formed, respectively, as a continuous or integral part welded in place after the body members 12 and 14 are assembled. Still further, the bottom body member 14 advantageously includes a plurality of one piece digging teeth 133 spaced apart on and welded to the lip part 94, as shown in FIGS. 1, 2 and 3.

The dipper 10 may be constructed using conventional engineering materials, such as moderate-strength steel plate, suitably welded together at the joints of the parts as illustrated. Conventional fabrication of the various plate members, rib members and the like may be carried out, and conventional welding techniques may be used in joining the respective members to each other.

By way of example, a dipper having a 55 cubic yard capacity would measure roughly 160 inches length by 190 inches width, with an opening delimited by the front edge of approximately 124 inches height and an opening delimited by the rear edge 26 of about 72 inches height. Further, by way of example, the body member 12 is made up, for a dipper of the dimensions described, of a plate member 56 comprising ASTM T-1 structural carbon steel of nominal 1.0 inch thickness. The upper plate 56 may also be made of three parts comprising the side wall portions 59 and 60 and the top plate 58. The forward lip plate 62 may be made up of two parts of equal dimension and of a nominal 2.0 inch thickness. The key members of the body 14, characterized by the bottom plate 89 and the side wall plates 90 and 92, are typically 0.375 inch nominal thickness, and the lip plate 94 is preferably of 1.0-inch nominal thickness. The stiffening members 110 and 122 are preferably of 0.50-inch nominal thickness, and the ribs 100 and 102 are preferably made up of steel plate of nominal thickness of 1.0 inches. All of the members mentioned above, save the lip parts 94 and 100, are preferably formed of T-1 steel, quenched and tempered, and the parts 94 and 100 are preferably ASTM A36 steel.

Although a preferred embodiment of the present invention has been described in detail herein, those skilled in the art will recognize that various substitutions and modifications may be made to the dipper assembly without departing from the scope and spirit of the invention, as recited in the appended claims.

What is claimed is:

1. An excavating dipper comprising a generally hollow box having a front opening and a rear dump opening and being characterized by a top body member defined by a metal plate having a generally horizontal top wall and depending side walls; and a bottom body member adapted to be detachably connected to said top body and defined by a relatively thin-walled plate member having a bottom wall and generally upstanding side wall portions, and plural longitudinally extending stiffening ribs disposed on and secured to the plate members of said bottom body member on the exterior surface thereof; and means for detachably securing said top body member to said bottom body member so that said bottom body member can be replaced from time to time when worn out by excavating earth material and the like.

2. The excavating dipper set forth in claim 1 wherein:

said top body member includes a forwardly projecting lip part forming part of the top wall and side walls of said top body member and being formed of metal plate having a thickness greater than the plate defining the remainder of said top body member.

3. The excavating dipper set forth in claim 2 wherein:

said forward lip part is welded to said plate of said top body member.

4. The excavating dipper set forth in claim 2 wherein:

said top body member includes at least one transversely extending girth rib extending along said side walls and said top wall of said top body member.

5. The excavating dipper set forth in claim 4 wherein:

said top body member includes at least two transverse girth ribs, spaced apart one from the other, extending along said side walls and said top wall.

6. The excavating dipper set forth in claim 5 wherein:

said girth ribs are formed as generally hollow box beams wherein the plate forming the side walls and top wall of said top body member also forms at least one side of said box beams, respectively.

7. The excavating dipper set forth in claim 6 including:

means forming spaced-apart support bosses on said upper body member and secured to said top wall for supporting a dump door for said dipper and for supporting said dipper on a power shovel or the like.

8. The excavating dipper set forth in claim 1 wherein:

said bottom body member includes a forward projecting lip part forming at least a portion of the side wall and bottom wall portions of said bottom body member and being of a nominal thickness greater than the thickness of the plate member forming the side wall portions and bottom wall of the remainder of said bottom body member.

9. The excavating dipper set forth in claim 8 wherein:

said forward projecting lip part is welded to a front edge of said plate member forming said remainder of said bottom body member.

10. The excavating dipper set forth in claim 1 wherein:

said bottom body member includes spaced-apart transverse girth ribs extending along said side walls and said bottom wall of said bottom body member.

11. The excavating dipper set forth in claim 9 including:

a wear band disposed adjacent to the front edge of said lip part and secured thereto along side wall and bottom wall portions of said lip part.

12. The excavating dipper set forth in claim 1 wherein:

said top body member and said bottom body member are secured to each other along cooperating longitudinal flanges extending along the side wall portions of said top body member and said bottom body member.

13. The excavating dipper set forth in claim 1 including:

a plurality of excavating teeth disposed on said bottom body member and projecting from a forward edge thereof, said teeth each being formed as an integral part welded to said bottom body member.

14. A fabricated bottom body member for an excavating dipper comprising a generally hollow box having a front opening and a rear dump opening and being characterized by a top body member having a generally horizontal top wall and depending side walls, said bottom body member comprising:

a relatively thin-walled plate member forming a bottom wall and generally upstanding side wall portions, and plural longitudinally extending stiffening ribs disposed on and secured to said plate member on the exterior surface thereof; and means for detachably securing said bottom body member to said top body member so that said bottom body member can be replaced from time to time when worn out by excavating earth material and the like.

15. The invention set forth in claim 14 wherein:

said bottom body member includes a forward projecting lip part forming at least a portion of the side wall and bottom wall portions of said bottom body member and being of a nominal thickness greater than the thickness of the plate member forming the side wall portions and bottom wall of the remainder of said bottom body member.

16. The invention set forth in claim 15 wherein:

said forward projecting lip part is welded to a front edge of said plate member forming said remainder of said bottom body member.

17. The invention set forth in claim 14 wherein:

said bottom body member includes spaced-apart transverse girth ribs extending along said side walls and said bottom wall portions of said bottom body member.

18. The invention set forth in claim 16 including:

a wear band disposed adjacent to the front edge of said lip part and secured thereto along side wall and bottom wall portions of said lip part.

19. The invention set forth in claim 14 wherein:

said top body member and said bottom body member are secured to each other along cooperating longitudinal flanges extending along the side wall portions of said top body member and said bottom body member, respectively.

20. A fabricated top body member for an excavating dipper comprising a generally hollow box having a front opening and a rear dump opening and being characterized by said top body member and a bottom body member adapted to be detachably connected to said top body member, said top body member including:

a fabricated metal plate defining a top wall and depending sidewall portions; and a forwardly projecting lip part forming part of said top wall and side walls of said top body member and being formed of metal plate having a thickness greater than the plate defining the remainder of said top body member.

21. The invention set forth in claim 20 wherein:

said forward lip part is welded to said plate of said top body member.

22. The invention set forth in claim 20 wherein:

said top body member includes at least one transversely extending girth rib extending along said side walls and said top wall of said top body member.

23. The invention set forth in claim 22 wherein:

said top body member includes at least two transverse girth ribs, spaced apart one from the other, extending along said side walls and said top wall.

24. The invention set forth in claim 23 wherein:

said girth ribs are formed as generally hollow box beams wherein the plate forming the side walls and top wall of said top body member also forms at least one side of said box beams, respectively.

* * * * *